US008551228B2

(12) United States Patent
Chan

(10) Patent No.: US 8,551,228 B2
(45) Date of Patent: Oct. 8, 2013

(54) COLLECTOR MODULES FOR DEVICES FOR REMOVING PARTICLES FROM A GAS

(71) Applicant: Sik Leung Chan, Tsuen Wan (HK)

(72) Inventor: Sik Leung Chan, Tsuen Wan (HK)

( * ) Notice: Subject to any disclaimer, the term of this patent is extended or adjusted under 35 U.S.C. 154(b) by 0 days.

(21) Appl. No.: 13/712,116

(22) Filed: Dec. 12, 2012

(65) Prior Publication Data

US 2013/0098247 A1 Apr. 25, 2013

Related U.S. Application Data

(63) Continuation of application No. 12/658,359, filed on Feb. 5, 2010, now Pat. No. 8,357,233.

(60) Provisional application No. 61/210,551, filed on Mar. 20, 2009.

(51) Int. Cl.
*B03C 3/08* (2006.01)
*B03C 3/70* (2006.01)

(52) U.S. Cl.
USPC ..... 96/81; 96/86; 96/88

(58) Field of Classification Search
USPC ..... 96/39–41, 77–84, 86–88, 95–100; 95/77, 79
See application file for complete search history.

(56) References Cited

U.S. PATENT DOCUMENTS

| | | | | |
|---|---|---|---|---|
| 2,535,697 | A | 12/1950 | Roos | |
| 2,565,458 | A | 8/1951 | Weisz | |
| 2,615,529 | A | 10/1952 | Lincoln | |
| 2,658,582 | A | 11/1953 | Wintermute | |
| 2,822,057 | A | 2/1958 | Richardson | |
| 2,908,348 | A | 10/1959 | Rivers et al. | |
| 3,262,250 | A | 7/1966 | Fowler | |
| 3,289,392 | A | 12/1966 | Fowler | |
| 3,509,696 | A | 5/1970 | Thompson | |
| 3,837,145 | A | 9/1974 | Festner | |
| 3,985,524 | A * | 10/1976 | Masuda | 96/32 |
| 4,177,047 | A | 12/1979 | Goland | |
| 4,553,987 | A | 11/1985 | Artama et al. | |
| 4,602,921 | A * | 7/1986 | Shinohara et al. | 96/79 |
| 5,290,343 | A | 3/1994 | Morita et al. | |

(Continued)

FOREIGN PATENT DOCUMENTS

| | | | | |
|---|---|---|---|---|
| CA | 1319624 | | 6/1993 | |
| JP | 52-55065 | | 5/1977 | |
| JP | 6-134342 | A * | 5/1994 | 96/95 |

*Primary Examiner* — Richard L Chiesa
(74) *Attorney, Agent, or Firm* — Daniel P. Burke & Associates, PLLC

(57) ABSTRACT

Devices for removing particles for a gas utilizing electrostatic precipitation having collector modules with fewer electrical connections, which facilitate cleaning, and/or eliminate the need for high voltage connections between a removable collector module and a collector module support. Driver electrode modules provide electrical connection between an insulated driver electrode and a source of electrical potential or between insulated driver electrodes and at least one other conductor through a hole in or on some edge on the driver electrodes. A biasing force is provided and a conductive element serves as a conductor between the driver electrode(s) and the other conductors. A plurality of insulated driver electrodes, e.g. plates, are formed with a single, conductive plate or from a plurality of electrically joined conductive plates which are coated with insulation and then bent. An electrically-shielded, high voltage generating circuit is integrated with a readily removable collector module to eliminate the need for high voltage connections between the removable collector module and the collector module support, while enhancing the device's durability and allowing cleaning with cleaning fluid and/or dishwasher detergent.

21 Claims, 13 Drawing Sheets

(56) References Cited

U.S. PATENT DOCUMENTS

| | | | | |
|---|---|---|---|---|
| 5,364,458 | A | 11/1994 | Burnett et al. | |
| 5,484,473 | A | 1/1996 | Bontempi | |
| 5,846,302 | A | 12/1998 | Putro | |
| 6,126,727 | A | 10/2000 | Lo | |
| 6,294,004 | B1 | 9/2001 | Summers et al. | |
| 6,902,604 | B2 | 6/2005 | Heckel et al. | |
| 7,112,238 | B2 | 9/2006 | Joannou | |
| 7,132,009 | B2 | 11/2006 | Chiang | |
| 7,258,715 | B2 | 8/2007 | Cox et al. | |
| 7,332,019 | B2 | 2/2008 | Bias et al. | |
| 7,517,503 | B2 * | 4/2009 | Botvinnik et al. | 422/186.04 |
| 7,717,984 | B1 | 5/2010 | Schreiber | |
| 7,767,169 | B2 * | 8/2010 | Snyder et al. | 422/186.3 |
| 7,785,403 | B2 | 8/2010 | Ouyang et al. | |
| 7,833,323 | B2 | 11/2010 | Takayanagi et al. | |
| 7,909,918 | B2 | 3/2011 | Bias et al. | |
| 8,157,901 | B2 | 4/2012 | Tiefenauer et al. | |
| 8,357,233 | B2 * | 1/2013 | Chan | 96/39 |
| 2006/0016337 | A1 * | 1/2006 | Taylor et al. | 96/25 |
| 2006/0180027 | A1 | 8/2006 | McDonnell et al. | |
| 2006/0201328 | A1 | 9/2006 | Chiang | |
| 2007/0240742 | A1 | 10/2007 | Kwok et al. | |
| 2008/0028937 | A1 | 2/2008 | Paterson et al. | |
| 2008/0134896 | A1 | 6/2008 | Holmes et al. | |
| 2010/0236411 | A1 * | 9/2010 | Chan | 96/25 |

* cited by examiner

COLLECTOR MODULES FOR DEVICES FOR REMOVING PARTICLES FROM A GAS

RELATED APPLICATION DATA

This application is a continuation of U.S. patent application Ser. No. 12/658,359, filed on Feb. 5, 2010, which has issued as U.S. Pat. No. 8,357,233 on Jan. 22, 2013, which is hereby incorporated by reference. This application claims the benefit of Provisional Patent Application Ser. No. 61/210,551 filed on Mar. 20, 2009.

The present invention relates to devices for removing particles from gases comprising electrostatic precipitators, e.g. household air cleaners, and to collector modules and improved electrical connectors for such devices.

BACKGROUND

Some electrostatic air cleaners utilize an electrical potential difference between spaced collector electrode plates and driver electrode plates to facilitate particle deposition on the collector plates. For efficient collection of particles from air, a high potential, usually 10 kV to 30 kV, is applied between the collector plates and insulated driver plates. The use of such high potentials creates the risk of damaging arcing between components at different potentials and necessitates additional steps in the manufacture and maintenance of the device. For example, the contact points, i.e. the portions where electrical connections are made between different components, particularly insulated components, must be properly shielded.

While a proper insulation will adhere well to the driver plates, problems tend to occur in the electrical contacts joining the insulated drivers to their source of electrical potential. At those contact points, the insulation on the insulated drivers and the insulation on connecting conductors are opened in order to make the contact. If the contacts are left unshielded, the contact points must be far enough from the collector plates, i.e. the creeping distance between those contacts and the collector plates will have to be sufficient, to avoid arcing. The term "creeping distance" is used herein to indicate the distance between the two closest points on the surface of the insulated structures of oppositely charged components. Additionally, particles initially entrained in the air, e.g. dust and dirt, particularly when combined with high humidity, will collect on one or more of the plates and can shorten the effective "creeping distance". In other words, the particles which accumulate along and around areas where the creeping distance is minimal can form a conductive path between the opposed conductors. Electrical shorts and arcing can result and cause irreversible damage to the device.

To make the design compact and reliable, and with the exception of a single point on each driver electrode for a plug or socket for the input of the required potential, the contact points on insulated driver electrodes are commonly shielded with epoxy. However, many good insulators such as polyester and Teflon do not bond very well with many epoxy materials. As the epoxy and the insulator are subjected to mechanical shocks and/or temperature variations, over time small cracks tend to develop in the bonds. Water can be trapped in those cracks during washing processes. When the cracks propagate, the water will short the shielded contact. If the distance between the openings of the cracks and the collector plates is less than the distance required to avoid arcing, i.e. the arcing distance to the collector plates, arcing will occur and the collector module can be irreversibly damaged. Even when the distance between the openings of the cracks and the collector plates is longer than the arcing distance to the collector plates, their creeping distances will usually be rather small and do not provide stable operation since the accumulation of some moist dirt/particles can lead to arcing across the driver electrodes and collector plates. Moreover, the bond of the epoxy to the insulator will often degrade very quickly if it is subjected to dishwasher treatment.

SUMMARY OF THE INVENTION

The embodiments of the present invention comprise collector modules which are particularly useful with devices for removing particles from a gas, and will be described herein in the context of household air cleaners. The illustrated embodiments are designed to reduce the time and cost of manufacture while enhancing the long term reliability, allow the use of more vigorous as well as convenient cleaning methods such as using a dishwasher, and enable relatively compact structures. As used herein, the term "module" refers to a subassembly of components, including at least one driver electrode, which is useful in devices for removing particles from gases.

According to one embodiment of the present invention, the use of epoxy insulating material in a collector module comprising at least one and preferably a plurality of driver electrodes is significantly reduced. In this embodiment of the present invention, electrical communication is established between at least one and preferably a plurality of insulated driver plates and at least one other conductor and/or a source of electrical potential using a conductive electrical connector, such as a conductive screw, eyelet or similar fastener, which passes through a hole in or along an edge of the driver plate(s) and conductor. The portions of the driver plate(s) and other conductors in which electrical communication(s) are established are physically biased toward each other, preferably by the conductive connector, or alternatively by another biasing member. If a non-fastener type conductive electrical connector is used, the driver electrode and the other conductive part can be biased together by a separate element, e.g. a clamp. If this collector module comprises only one driver, the other conductor may be a contact which is connected to the voltage source.

According to another embodiment of the present invention, the number of electrical contact points between a source of electrical potential and insulated driver plates in a collector module is significantly reduced by forming a plurality of insulated driver plates from a single, bent, insulated conductive plate. In this embodiment, a single insulated conductive plate serves as a plurality of driver electrode plates positioned on opposite sides of at least one, and preferably a plurality of, collector electrodes, e.g. collector plates. The single conductive plate can be bent or formed to serve as a plurality of driver electrode plates.

According to another embodiment of the present invention, a shielded high voltage generating circuit, collector electrodes and driver electrodes and, optionally one or more emitters, are integrated into in a single, machine washable, collector module which is easily removable from a collector module support and which can withstand repeated cleanings with cleaning fluids such as dishwasher detergents. Since the high voltage output(s) of the high voltage generating circuit are shielded as part of the collector module, the connections between the collector module and the collector module support can be limited to low voltage power, ground and control inputs, thereby avoiding the need for a high voltage input to the collector module. This embodiment of the present invention facilitates easy and regular cleaning of the collector module. This embodiment also eliminates the need for additional safety features which are typically required in order to shield a user from high voltage shocks when removing a collector module from an air cleaner for cleaning.

DETAILED DESCRIPTION

Figure 2:
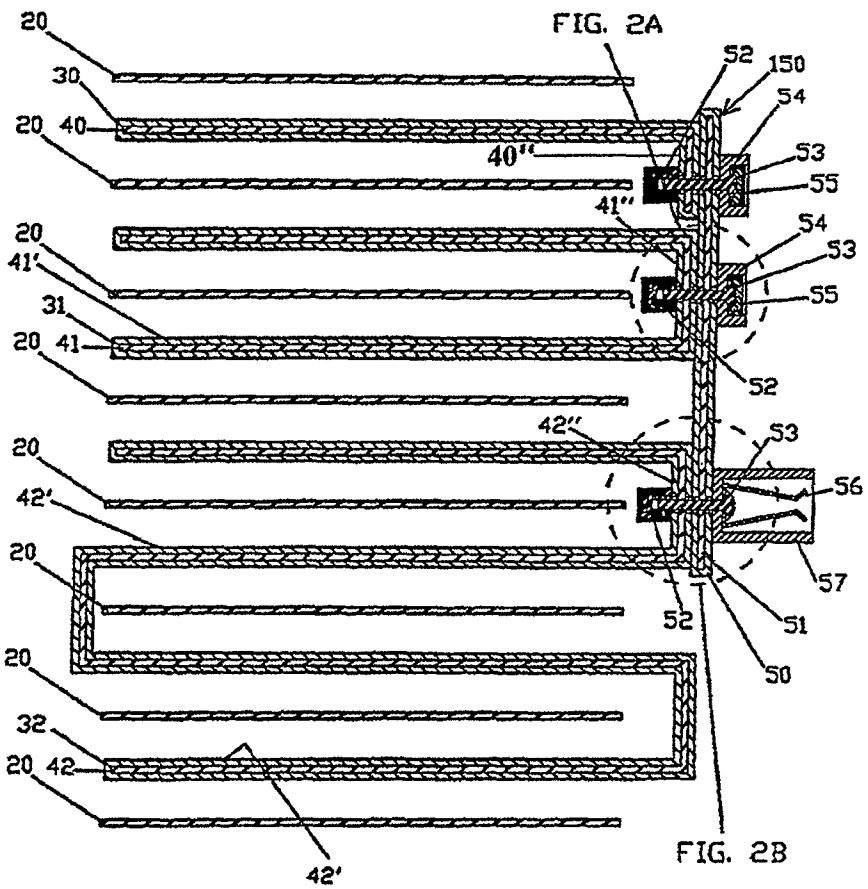
FIG. 2 is a cross-sectional front view of the collector module of FIG. 1 taken along lines 2-2 of FIG. 1.
Figure 1:
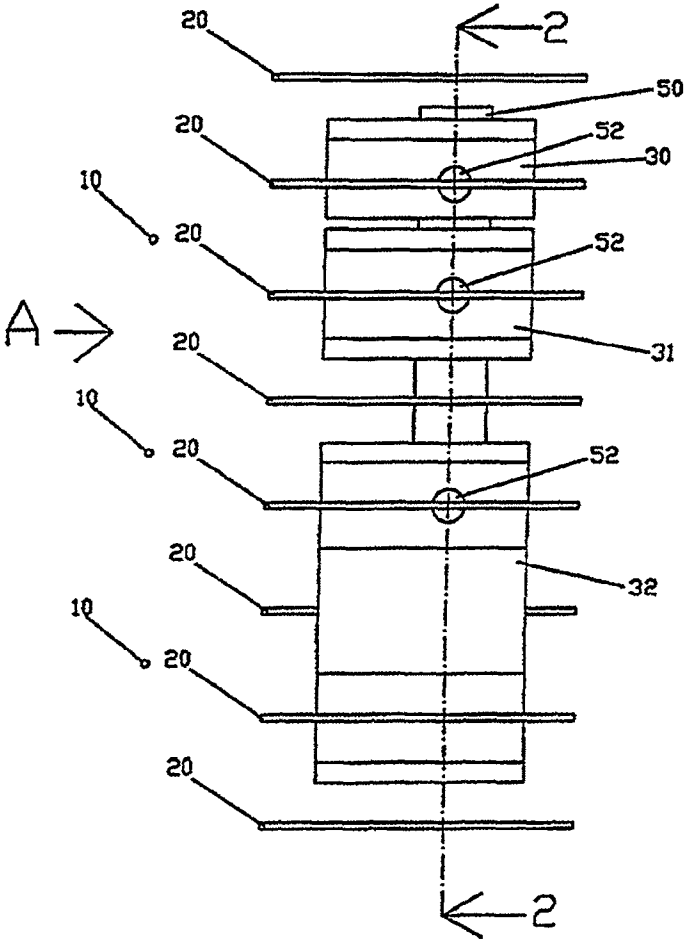
FIG. 1 is a left side view of a collector module of one embodiment of the present invention.
Figure 3:
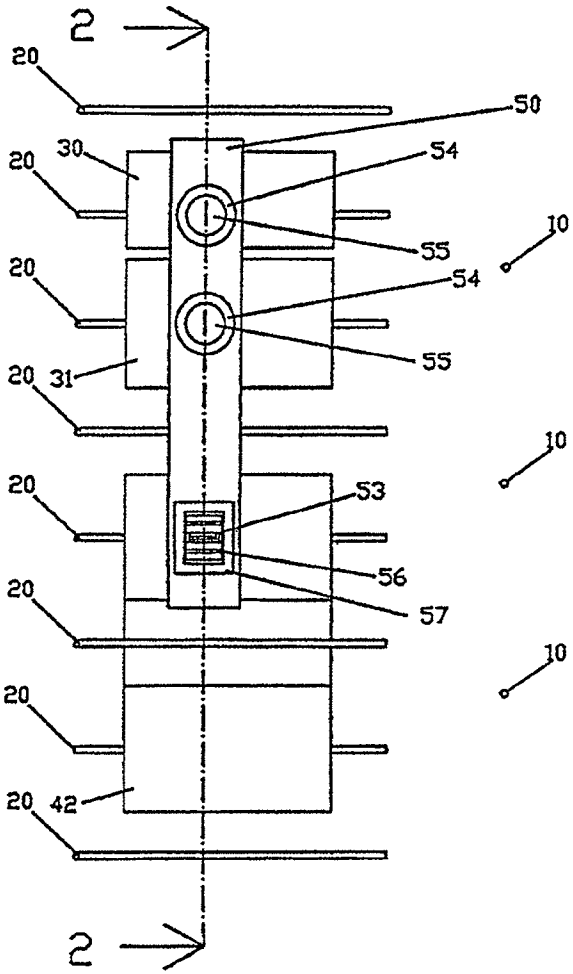
FIG. 3 is a right side view of the collector module of FIG. 1.

FIGS. 1 to 3 illustrate a collector module of the present invention embodying two aspects of the present invention which minimize the number of electrical connections to the insulated driver plates and minimize the use of epoxy. This illustrated collector module comprises eight collector electrodes 20 which are positioned with seven driver plates 40 positioned between them. Supporting structure and other components of the air cleaner are not shown in these figures. One or more emitters 10 can be included in the collector modules of this embodiment of the present invention, but in this illustrated embodiment, the illustrated emitters 10 are not part of the collector module. In this illustrated embodiment, the air flow is in the direction of arrow A shown in FIG. 1. The device can also be oriented in a different direction, e.g. for a vertical air flow, if desired.

As best shown in FIG. 2, four insulated driver electrode plates 42' are formed by bending a single, insulated, electrically conductive plate 42 having insulation 32. Alternatively, the single driver electrode module which comprises four driver electrode plates can be formed from a plurality of conductive plates which are electrically connected and then insulated. If there are a plurality of driver plates, it is sometimes more convenient to electrically connect several plates before applying insulation to them to form a single, long insulated plate, and then bending the long, insulated plate to form a driver electrode module comprising a plurality of electrically connected driver electrode plates. As used herein, the term "driver electrode plate" refers to a portion of a driver electrode module positioned in spaced relation to one surface of at least one collector electrode. The illustrated driver electrode module formed by single conductive plate 42 thus forms four "driver electrode plates" which drive particles toward eight different surfaces on five collector electrodes. While driver electrode plates are preferably substantially planar, driver electrode plates can have other shapes, e.g. curved. Portions of a driver electrode plate which are intended to cooperate with corresponding portions of collector electrodes are preferably equally spaced from those corresponding portions.

Another single, continuous conductive plate 41 forms two insulated driver electrode plates 41'. Driver electrode plates 41' are covered with insulation 31. In FIG. 2, the two insulated driver electrode plates 41' are shown positioned on either side of the third collector plate 20.

By forming a plurality of driver electrode plates from a single insulated plate, the need for insulating a contact point on every driver electrode plate is eliminated since only one contact point is needed for each conductive plate. In the case of conductive plate 42, three contact points are eliminated. This saves on manufacturing steps, the material cost and labor of applying epoxy to the eliminated contacts, and avoids the weaknesses inherent in opening the insulation 32 and adhering epoxy to insulation 32 for each contact point which is eliminated.

While the illustrated driver electrode modules which comprise a plurality of driver electrode plates are preferred, other driver electrode modules of the present invention comprise a plurality of insulated driver electrodes formed of conductive wires and/or conductive strips which are arranged in the same general shape as the illustrated driver electrode plates. The wires and strips can be individually insulated or collectively insulated, and can either abut adjacent wires/strips or be spaced from them.

In the collector module illustrated in FIGS. 1-3, and as best shown in FIGS. 2 and 3, an insulated electrical connector 150 is used to electrically connect a plurality of driver electrodes to each other. In this illustrated embodiment, the connector 150 also connects the driver electrodes to a source of electrical potential. More specifically, according to this embodiment, the insulated electrical connector 150 which comprises a conductive strip 51 coated with insulation 50, together with conductive screws 53, insulator nuts 52 and insulating cups 54/insulation socket 57, connects the insulated driver electrodes to a source of electrical potential. The conductive strip 51 preferably comprises a metal while insulation 50 preferably comprises a polyester film. Other conductive materials and/or insulative material which shield the strip to prevent arcing with components at the other potentials may be utilized.

Figure 2A:
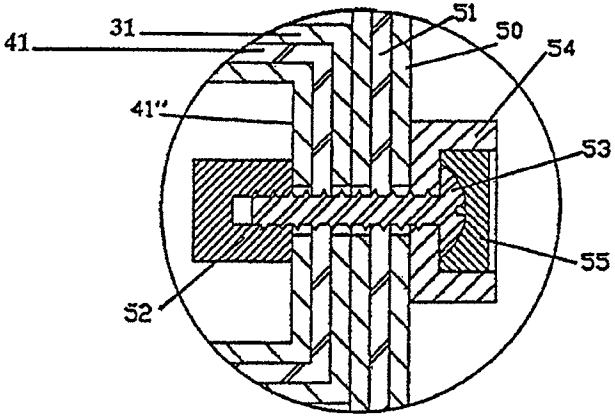
FIGS. 2A and 2B are enlarged views of the portions of FIG. 2 indicated by the corresponding dashed circles in FIG. 2.
Figure 2B:
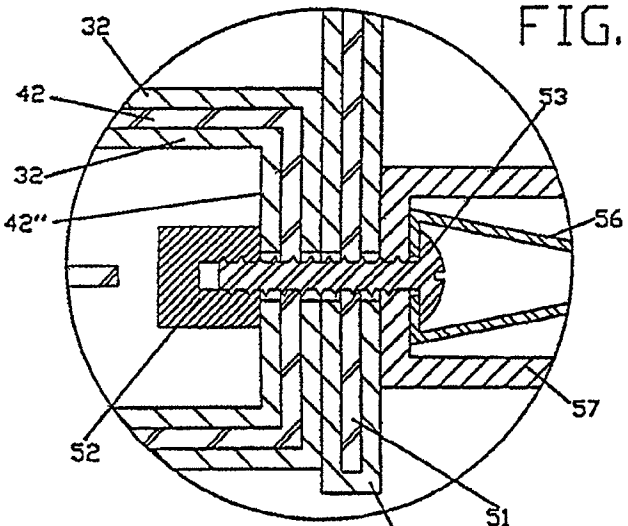

In order to form the electrical connection between the insulated electrical connector 150 and each of the driver electrodes, holes are formed through one layer of insulation 50, the conductive strip 51, and the other layer of insulation on the other side of conductive strip 51. Insulation 50 is preferably positioned on all sides and all edges of conductive strip 51. Similarly, holes are formed in each of the driver electrodes 40-42 and both layers of each insulating material 30-32, respectively, which is disposed on both sides of the driver electrodes as best shown in FIGS. 2A and 2B.

Figure 18:
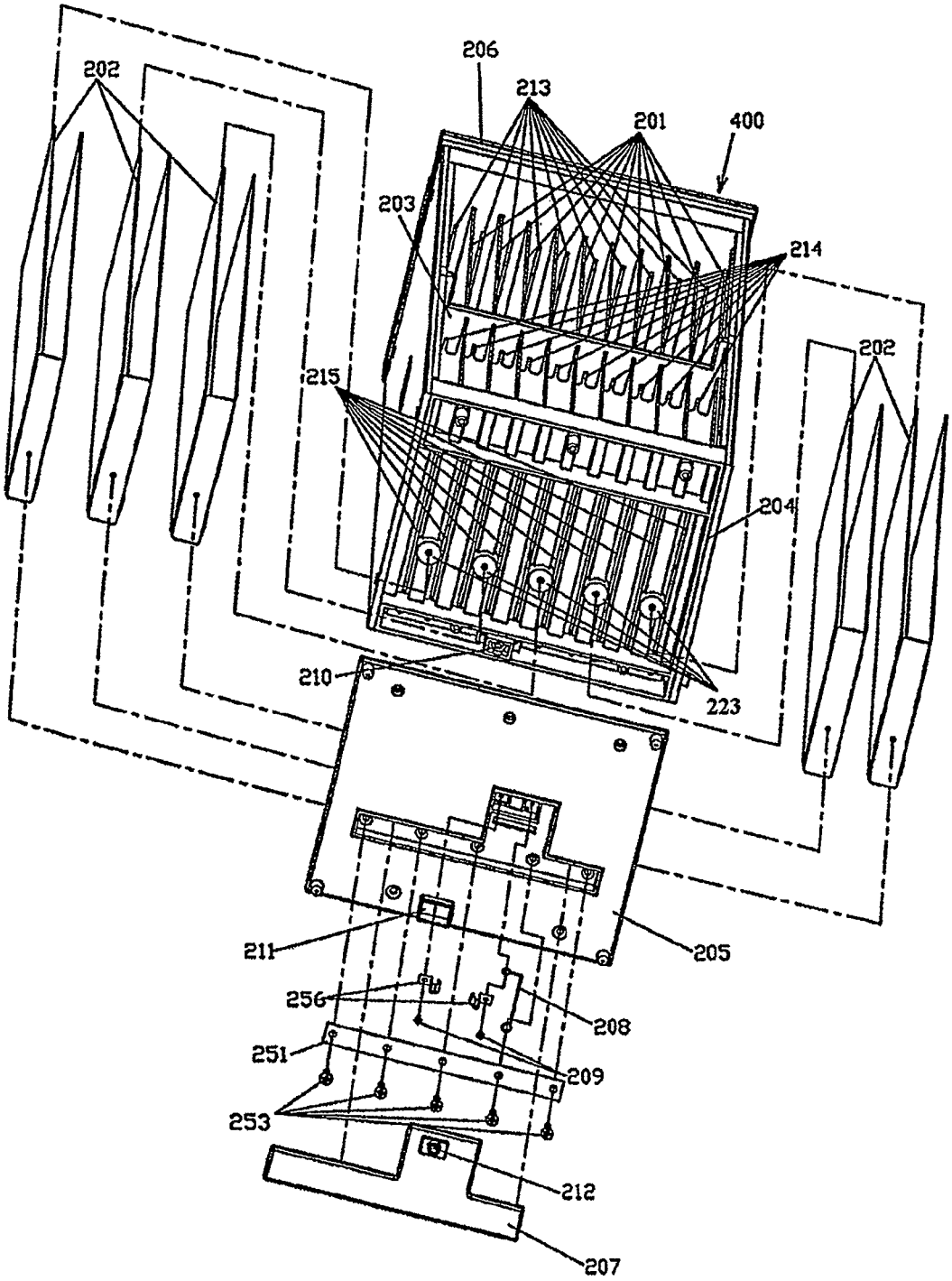
FIG. 18 is an exploded bottom perspective view of the collector module shown in FIG. 17.

The holes passing through the insulated electrical connector 150 are designed to align with the holes passing through the insulated driver plates. The holes in the conductive strip 51 and conductive driver plates 40-42 are preferably slightly smaller than the diameter of the screws 53. As the screws 53 are forced through the holes, electrical connections are made between the conductive plates 40-42 and conductive strip 51. Ideally, the conductive screws 53 would only make contact with interior walls which define the holes through the insulated electrical connector 150 and driver electrodes, however, during assembly, such as during the insertion of the screws through the conductive strip 51 and conductive portions of the driver electrodes, some deformation may occur and conductive screws 53 may contact small portions of the surfaces of the electrical connector 150 or the driver electrodes. Insulated nuts 52 are made of plastic material or other suitable insulating materials. Rather than using separate nuts 52, screws 53 can alternatively be received in other integrated, structural parts of the collector module or the air cleaner as shown in FIG. 18 below.

During assembly, the tightening of screws 53 between their respective nuts 52 and the insulating cups 54/insulation socket 57 will bias the insulated electrical connector 150 toward the driver electrodes thereby pressing insulation layer 50 of the connector 150 against the respective insulation layers 30-32 and forcing air out of the gaps between the separate, insulated conducting surfaces of the connector 150 and driver plates. Optionally a sealing material, such as silicon rubber, can be put in and/or around the holes to fill any air gaps and to enhance the sealing effect while minimizing the risk of over tightening the screws. The elimination of air coupled with the proper insulation of the conductive screws 53 and holes will prevent arcing between the screws 53, conductive strip 51 and driver electrodes, on one hand, and the collector plates 20 which are maintained at a different electrical potential and are spaced by a relatively small distance on the other hand.

Figure 7:
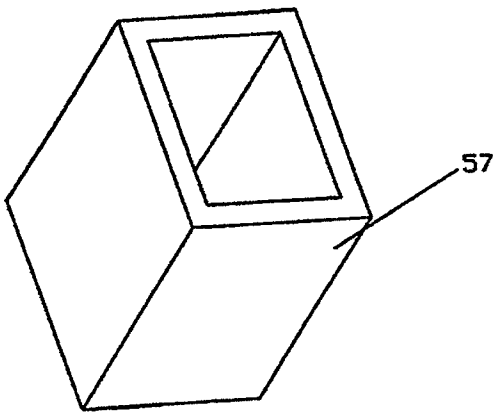
FIG. 7 is a perspective view of an insulation socket used in the collector module shown in FIG. 2.
Figure 6:
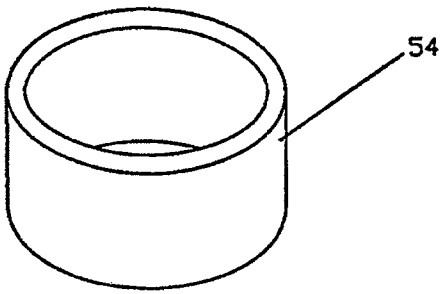
FIG. 6 is a perspective view of a screw head insulation cup used in the collector module shown in FIG. 2.

The insulating cup 54 and insulation socket 57 which are illustrated in FIGS. 6 and 7, respectively, both have flat bottoms with holes for the screws 53. Epoxy 55 can be put into insulating cups 54 to seal the screw heads or spring contact 56 can be connected to screw 53 inside the insulation socket 57 to enable the connection and disconnection of the driver plates to a suitable source of electrical potential. In this manner, the driver plates are completely insulated from the circuit of the collector plates within the collector module except at the point of potential input. In this manner, all of the insulated drivers are connected and insulated, even from the environment, except on the screw heads. The creeping distance from the point of potential input to the collector circuit can be made relatively long compared to other creeping distances for long term, stable operation.

This embodiment of the present invention provides a novel combination of insulating parts which work in combination with the insulation layers of the conductive plates 40-42 which are being connected. These insulating parts which include insulation 50, insulating cups 54, insulation socket 57 and insulating nuts 52 are designed to be non-conforming, that is non-parallel, to the insulated surfaces 40", 41" and 42" of the insulated driver electrode structure through which screws 53 pass and toward which the conductive strip 51 is biased. The insulating parts partially or totally contain the conductive elements, in this embodiment conductive strip 51 and conductive screws 53, which provide the desired electrical communication. The nonconforming insulating parts enable secure sealing of the conductive elements and substantially increase the distance through air which an arcing current would need to travel to jump between the connection point for the source of electrical potential to the driver electrodes and the collector electrodes. Furthermore, the portions of the electrical connectors, which establish electrical communication between the conductive strip 51 and the driver electrodes (in this embodiment the conductive screws 53), are thoroughly electrically protected and sealed between the insulating parts and the insulation layers of the driver electrodes.

Figure 5:
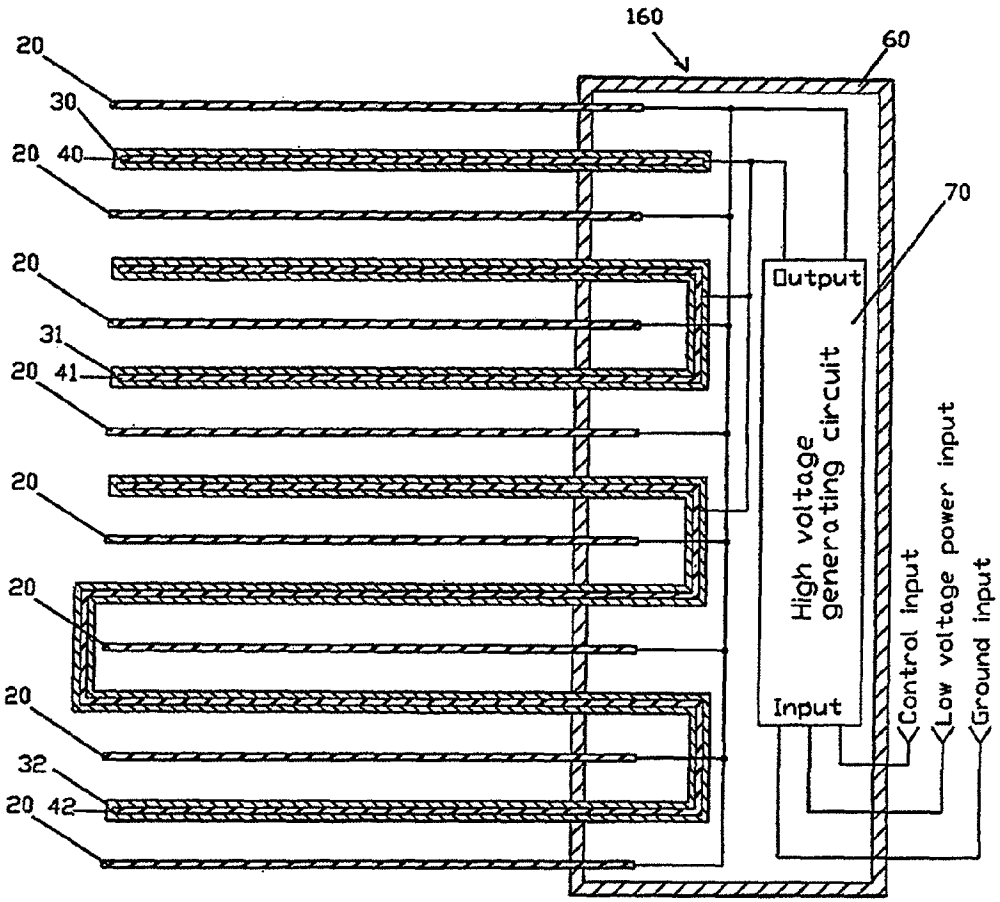
FIG. 5 is a cross-sectional, front diagrammatic view of the collector module of FIG. 4 taken along lines 5-5.
Figure 4:
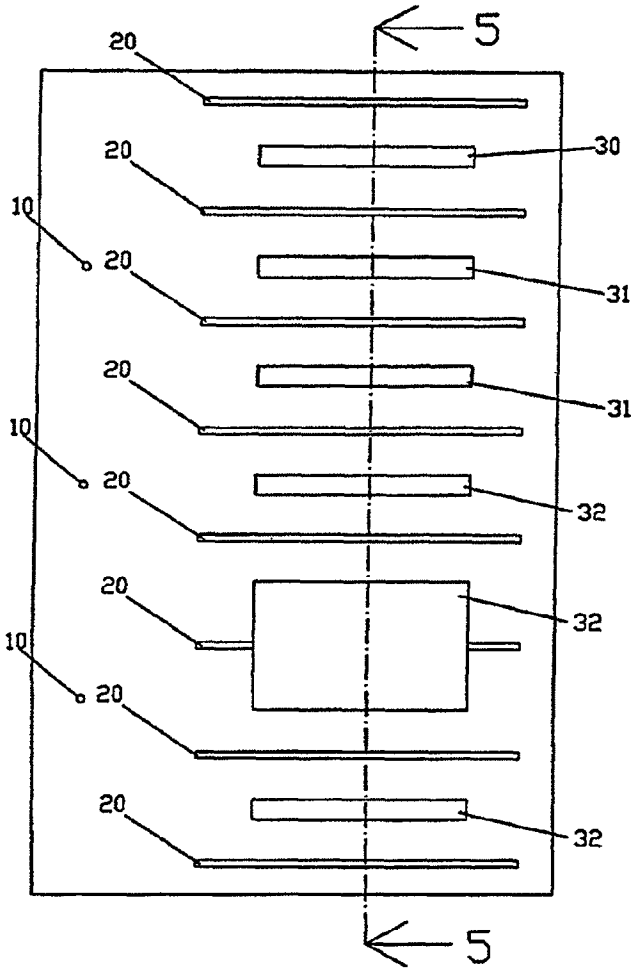
FIG. 4 is a side view of a collector module of a second embodiment of the present invention.

FIGS. 4 and 5 show a collector module 160 of an alternative embodiment of the present invention. According to this illustrated embodiment, the collector module comprises collector plates 20, driver electrodes 40-42 a high voltage generating circuit 70, and optionally emitters 10, integrated in a single, removable collector module. The high voltage generating circuit comprises two outputs of different potentials, for example a high voltage output and a ground output. All high voltage connections between the circuit 70 and the electrodes are thoroughly insulatively shielded in a shielded box 60.

The electrical connection(s) between the electrode plates and the high voltage circuit outputs can be conventional, as described above and shown in FIGS. 1-3, or as shown in other embodiments described below.

There are several advantages provided by the collector module shown in FIGS. 4 and 5. Initially, there is no need for any high voltage electrical contacts between this collector module and the rest of the air cleaner, e.g. the collector module support which provides structural support for collector module and electrical connections for a low voltage power input, a ground input and suitable control inputs. Such high voltage contacts are typically required to allow removal of high potential components, e.g. driver plates, for cleaning. Only low voltage power, ground and control inputs contacts are needed on the present collector module 160 since the high voltage potential is generated by circuit 70 and distributed to the electrodes, all within shielded box 60. As used herein, the term "low voltage" refers to voltages up to 300V. In other embodiments of the present invention, all high voltage connections are within a removable collector module, so there is no need for high voltage connections between the removable collector module and a collector module support. Secondly, since there are no high voltage components or connections required in the other parts of the air cleaner, the overall structure of the air cleaner can be made more simply and open to allow easier cleaning. Also, interlocking circuits which are typically required in air cleaners to protect a user from shock when a collector module is removed for cleaning are not necessary.

Additionally, all of the high voltage parts which are exposed to the environment, the emitters/drivers or the collector plates, are preferably part of this easily removable collector module. All of these components should be cleaned regularly and having all of them in a single, removable module makes cleaning easier. Moreover, this module can be cleaned in a conventional home dishwasher without damaging the components. Regular cleaning will help to keep the creeping distance constant to ensure stable operation.

If desired, for example in a circuit having a grounded emitter, the emitter can be installed on separate structures i.e. not on or as part of this removable module. If the emitters are maintained at a high (positive or negative) potential, it is preferable to include the emitters in the removable module since doing so will eliminate all high voltage contact between the disclosed removable module and the rest of the device. If the design arrangement allows the use of a high potential (positive or negative) receptor/collector and a grounded emitter configuration, the emitter can be fixed on structure other than the removable module without causing reliability problems.

According to another, less preferred embodiment, high potential emitters are not part of a removable module comprising the high voltage generating circuit, collector electrodes and driver electrodes. This embodiment does not offer the advantage mentioned above relating to the interlocking circuits. In another less preferred embodiment either a collector electrode or a driver electrode are not part of the removable module. The main advantage of this aspect of the invention is the insulative isolation of the high voltage parts to eliminate the need for high voltage connections between the removable collector module and the rest of the air cleaner.

Figure 9:
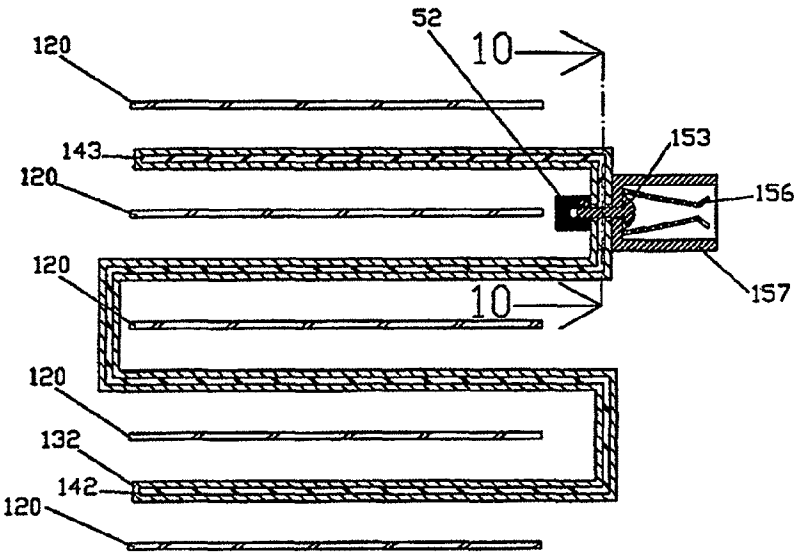
FIG. 9 is a cross-sectional, front view of the collector module of FIG. 8 taken along lines 9-9 of FIG. 8.
Figure 8:
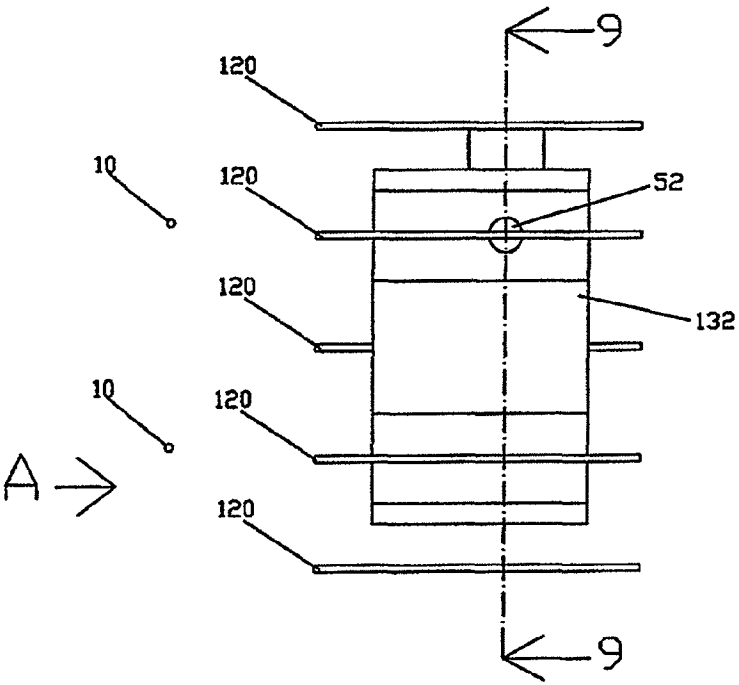
FIG. 8 is a side view of a collector module of a third embodiment of the present invention.
Figure 10:
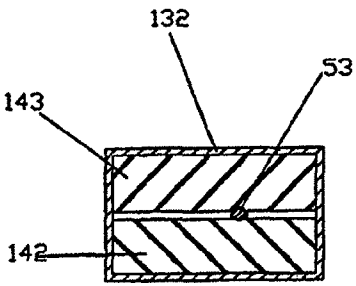
FIG. 10 is a cross-sectional view taken along lines 10-10 of FIG. 9.

FIGS. 8-10 illustrate a third embodiment of the present invention wherein an electrical connector, in this illustrated embodiment screw fastener 153, is used to connect two separate driver plates 142 and 143. Unlike the embodiment described above with respect to FIGS. 1-3, in the embodiment shown in FIGS. 8-10, the screw 153 is not passing through a hole in a driver plate but rather it is in contact with uninsulated portions of the edges of two plates 142, 143 which are both encased within insulation 132. As best shown in the cross-sectional views of FIGS. 9 and 10, conductive screw 153 is in contact with edges of both driver plate 142 and driver plate 143. In this manner, driver plates 142 and 143 are maintained at the same potential. Plates 142 and 143 can be supported by insulation 132 if the insulation is sufficiently strong. Alternatively, additional supports positioned externally of the insulation (not shown) can be utilized. While this illustrated embodiment shows fastener screw 153 as also comprising a spring contact 156 for connection with a source of electrical potential, it is also within the scope of this embodiment of the present invention to utilize screws 153 or other types of conductors to electrically connect the edges of adjacent driver plates at points other than the point where the driver plates are connected to a source of electrical potential.

Figure 12:
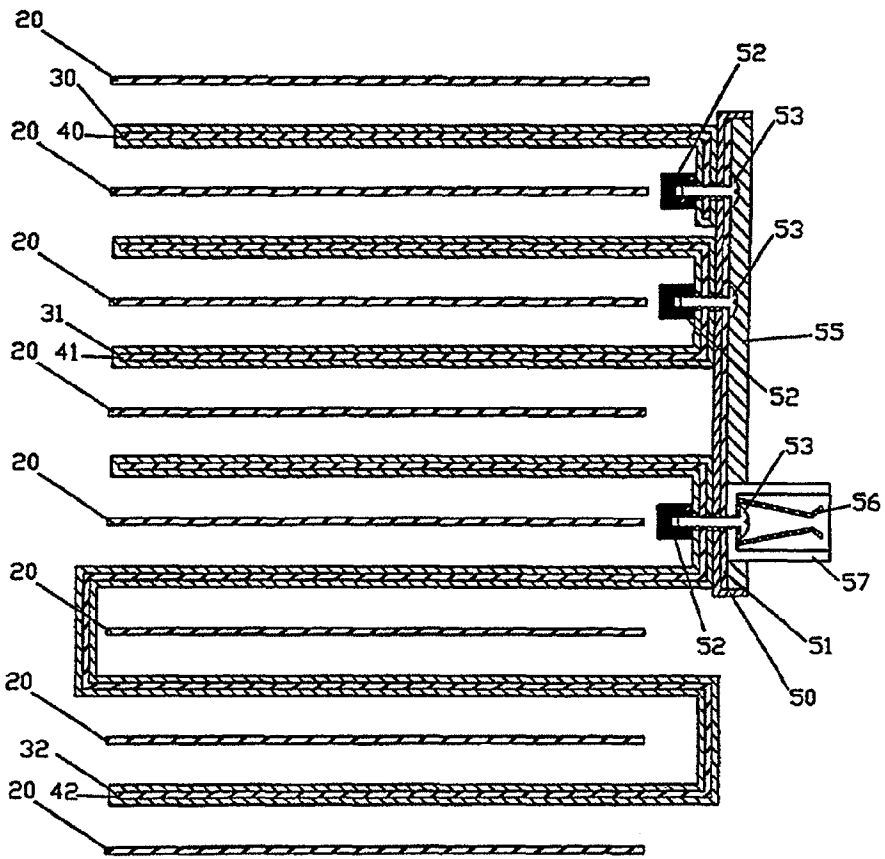
FIG. 12 is a cross-sectional, front view of the collector module of FIG. 11 taken along lines 12-12 of FIG. 13.
Figure 11:
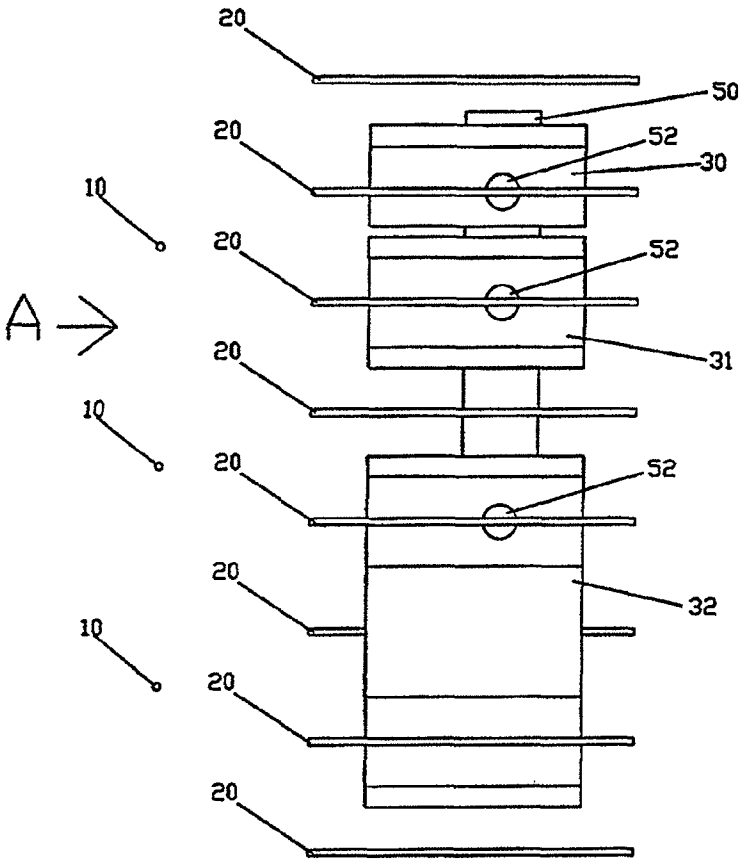
FIG. 11 is a side view of an alternative embodiment of a collector module of the present invention.
Figure 13:
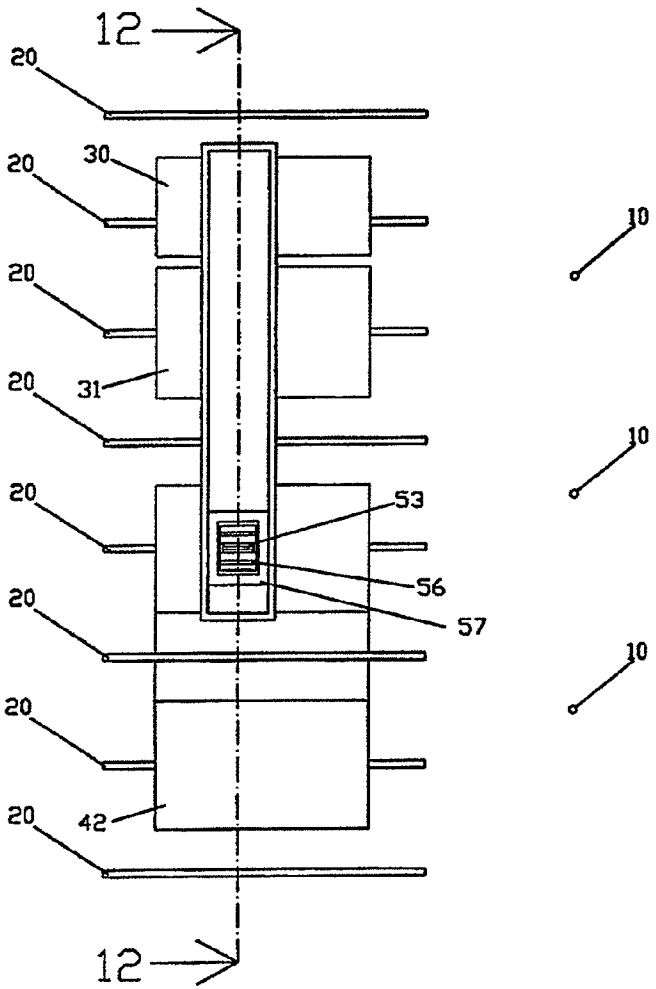
FIG. 13 is a right side view of collector module of FIG. 11.

FIGS. 11-13 illustrate a further embodiment of the present invention which is similar to the embodiment described above in connection with FIGS. 1-3 and where like numerals refer to identical elements, with the exception of element 55. As best shown in FIG. 12, element 55 is an electrically insulating potting material, such as an epoxy, which is used to insulate the side of conductive strip 51 which is opposite the driver electrodes. Additionally, insulator 50 is formed with projecting sides, shown on the top and bottom as oriented in FIG. 12, in order to receive the potting material during manufacturing.

Figure 15:
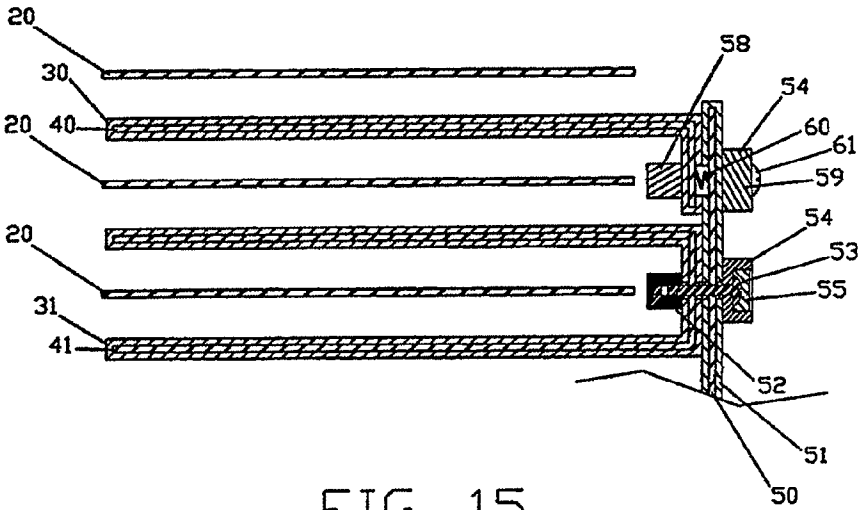
FIG. 15 is a cross-sectional, front view of the portion of the collector module shown in FIG. 14 taken along lines 15-15 of FIG. 14.
Figure 14:
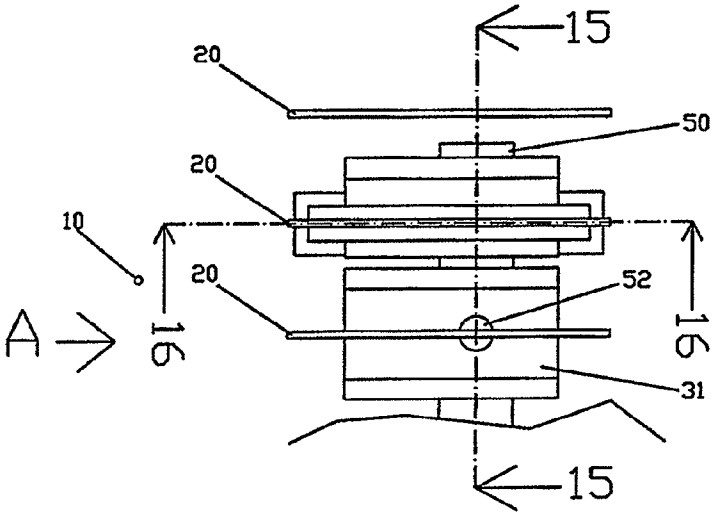
FIG. 14 is a partial side view of a collector module of a still further embodiment of the present invention.
Figure 16:
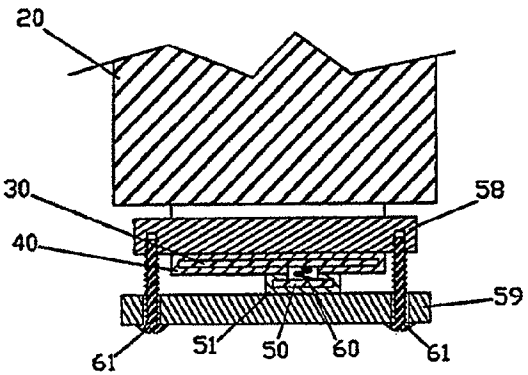
FIG. 16 is a cross-sectional view of the portion of the collector module shown in FIG. 14 taken along lines 16-16 of FIG. 14.

As noted above, the electrical connectors which provide electrical communication between conductive strip 50 and the conductive portions of driver electrodes can have a form other than a threaded screw, such as a rod or a grommet. FIGS. 14-16 illustrate another connector in the form of a conductive elastic contact, as one such example.

With reference to FIG. 16, a conductive elastic contact 60 is positioned between exposed portions of conductive strip 50 and the conductive portion 30 of driver electrode. The illustrated conductive elastic contact 60 is a small compression spring which can optionally be integrally formed with either the conductive strip 50 or the conductive portion 30 of a driver electrode. Alternatively, a small leaf spring or a small piece of conductive rubber can be utilized as the conductive elastic contact. As indicated, the insulation layer 40 of the driver electrode and the insulation layer 51 which substantially encloses conductive strip 50 have been partially removed to provide space for conductive elastic contact 60. According to this illustrated embodiment, the electrical connector comprising conductive strip 50 and insulation 51 is maintained in close contact with a portion of the driver electrode by a pair of clamps formed of insulated sections 58 and 59 which are maintained in position by insulated threaded screws 61. This embodiment illustrates that the biasing member which provide a force urging the driver electrode(s) 30 toward the conductive strip 50 or connection to a source of electrical potential need not be the actual element which is providing the electrical communication. In this embodiment, conductive elastic contact 60 provides the electrical communication while the clamping elements 58, 59 and 61 provide the biasing force.

As shown in FIG. 15 which illustrates a portion of one module of the present invention, different types of connections can be utilized to connect a single electrical connector with a plurality of driver electrodes. In FIG. 15, the upper connection is provided with a conductive elastic contact 60 while the lower connection is provided with a conductive threaded screw 53.

Figure 17:
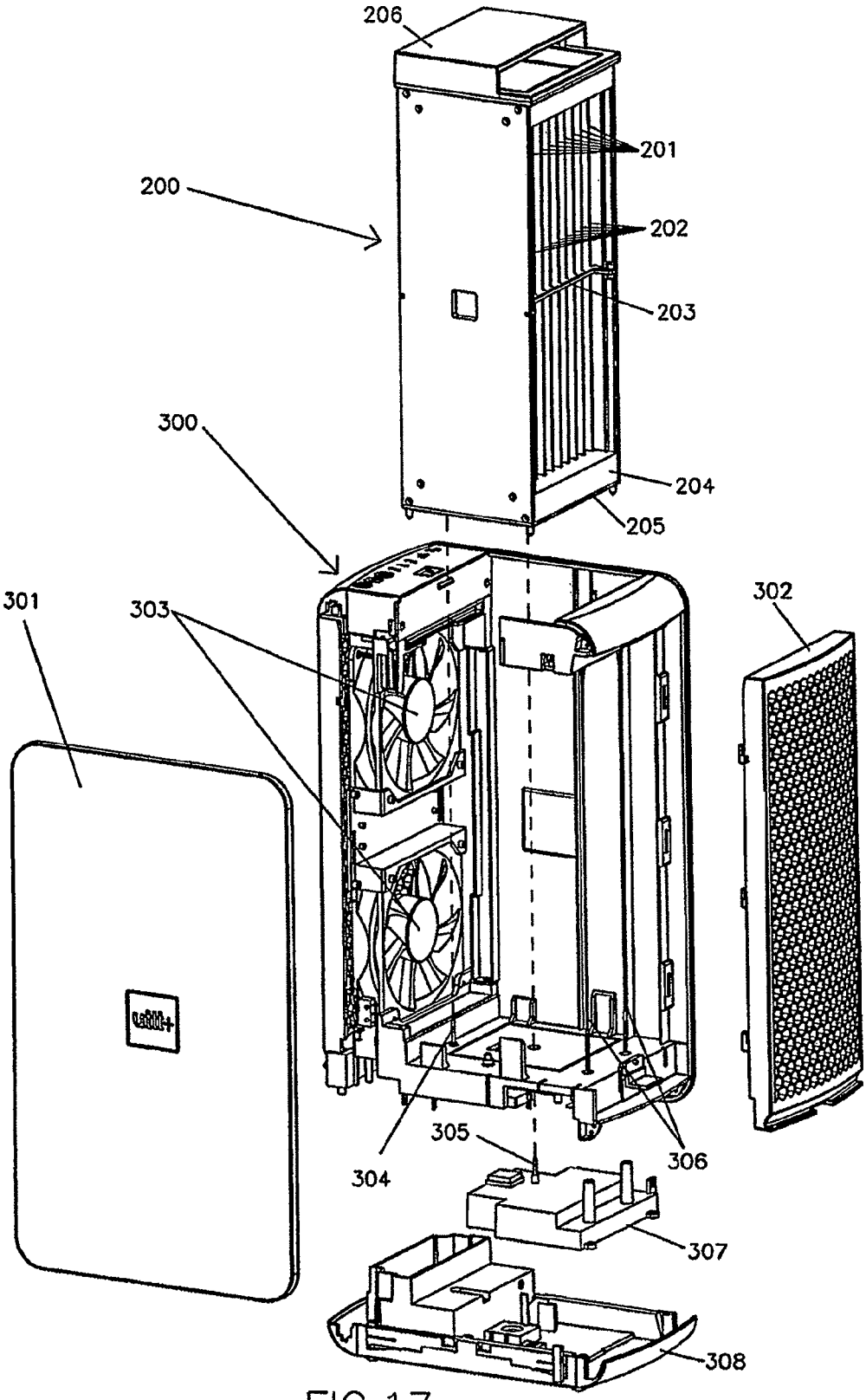
FIG. 17 is a partially exploded, perspective view of an air cleaner illustrating several aspects of the present invention

FIG. 17 is a partially exploded view of one air cleaner of the present invention comprising a removable collector module 200 and a collector module support 300. One side panel 301 and an air inlet cover 302 are detached to show how collector module 200 is electrically connected to electrical contact pins 304 and 305 which provide the correct electrical potentials to the collector plates 201 and insulated driver plates 202, respectively, when collector module 200 is installed. FIG. 17 also indicates the position of the collector module 200 in the air path of the fans 303(when installed). In this illustrated embodiment, two ionization wires 306 charge the particles in the air before they reach the collector 200. In this embodiment, the ionization wires are not part of the removable collector module.

FIG. 18 is an exploded, bottom perspective view of the collector module 200 illustrated in FIG. 17. FIG. 18 illustrates one preferred manner of connecting the insulated driver electrodes 202 with their related connections. Insulated driver electrodes 202 are inserted through slits 215 in the bottom of connection box 204, through slots 214 on a plate stabilizer 203 and finally with their ends into slits 213 located on the lower side of the lower portion of two-tiered handle 206.

The connection of the insulated driver electrodes 202 to a source of electrical potential is similar to that shown in FIGS. 11 to 13. Conductive screws 253 pass through holes in connector strip 251, holes in lower box cover 205, and holes in insulated drivers 202 and are secured to the integrated nuts 223 on connection box 204. This connects all of the insulated drivers 202 electrically together and fixes the box cover 205 onto connection box 204. Additionally, as shown in FIG. 18, one of the conductive screws 253 also passes through a loop in connection wire 208 to provide electrical communication between the connection wire 208 and connector strip 251.

Connection wire 208 connects the conductive connector strip 251 to socket contacts 256 which are fixed by screws 209 on lower box cover 205. Socket contacts 256 make contact with pin 305 through hole 212 on the contact cover 207 as the collector module 200 is inserted into support 300. Screws 253, connection strip 251 and connection wire 208 are covered with epoxy (not shown) and socket contacts 256 are exposed to air for connection.

The collector plates 201 are connected through socket 210 on connection box 204 and hole 211 on lower box cover 205 to pin 304 of the collector module support 300. Conventional connection methods are used to connect the collector plates 201. Handle 206, connection box 204, lower box cover 205 and contact cover 207 are made of electrically insulative material. Thus, this air cleaner of the present invention comprises five driver electrode modules each comprising a plurality of insulated driver electrode plates formed from a single, insulated conductive sheet, and a single electrical connector 251 which electrically connects ten driver electrode plates to a source of electrical potential utilizing a single exposed connection (socket contacts 256).

Figure 19:
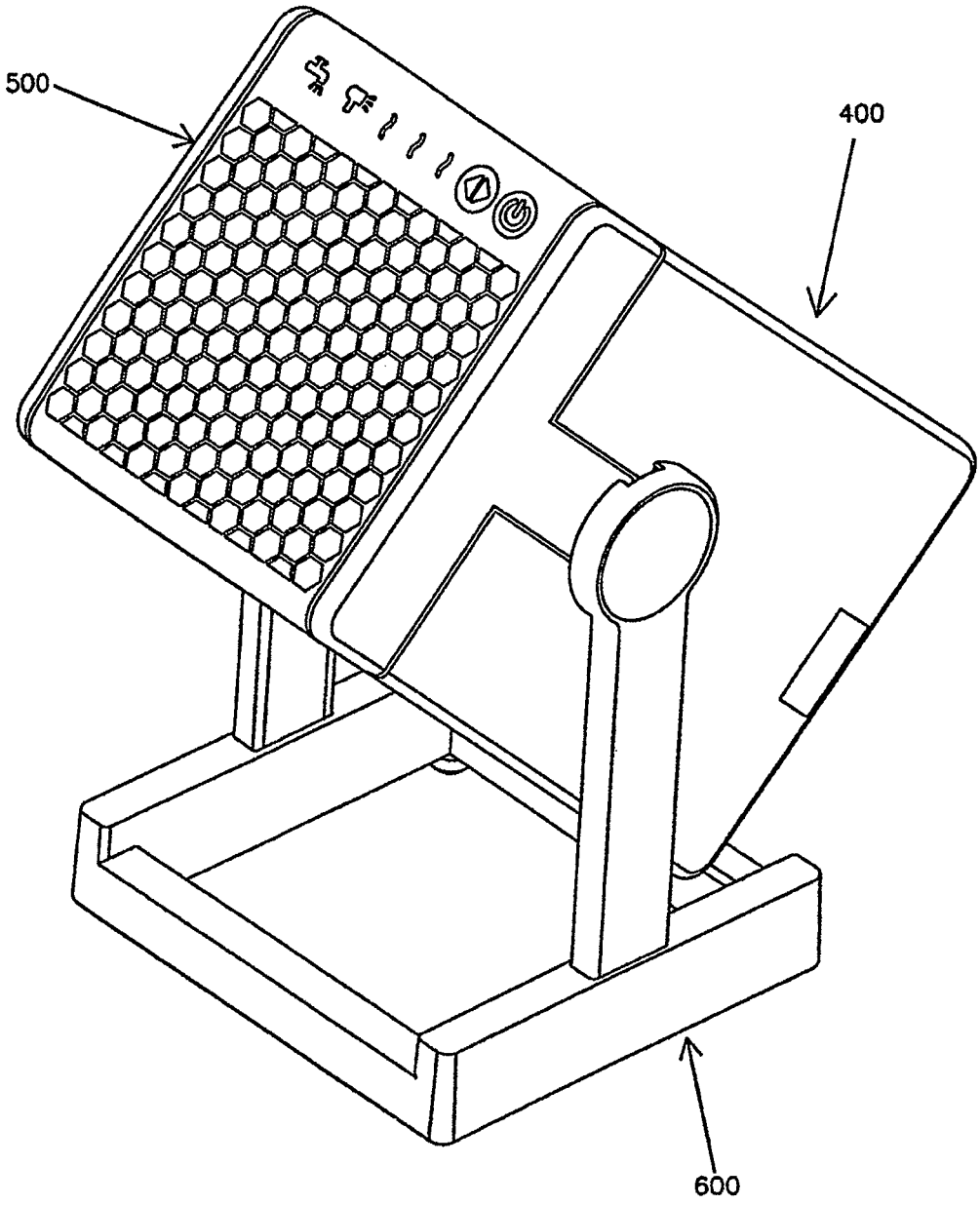
FIG. 19 is a perspective view of another air cleaner of the present invention with a collector module and collector module support tilted about 45°.
Figure 20:
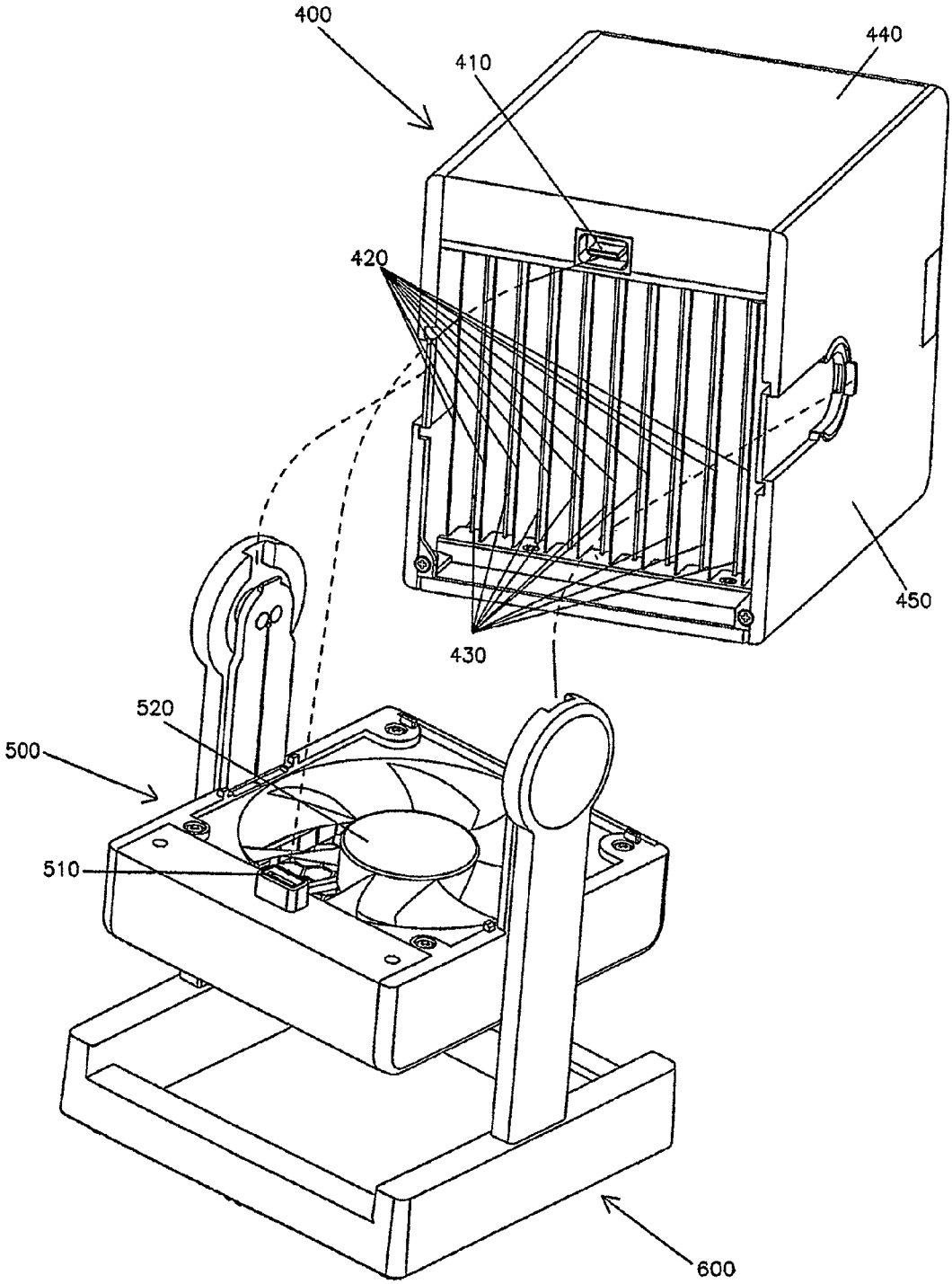
FIG. 20 is a perspective view of the air cleaner of FIG. 19 showing the collector module support in a vertical position and the collector module disconnected.
Figure 21:
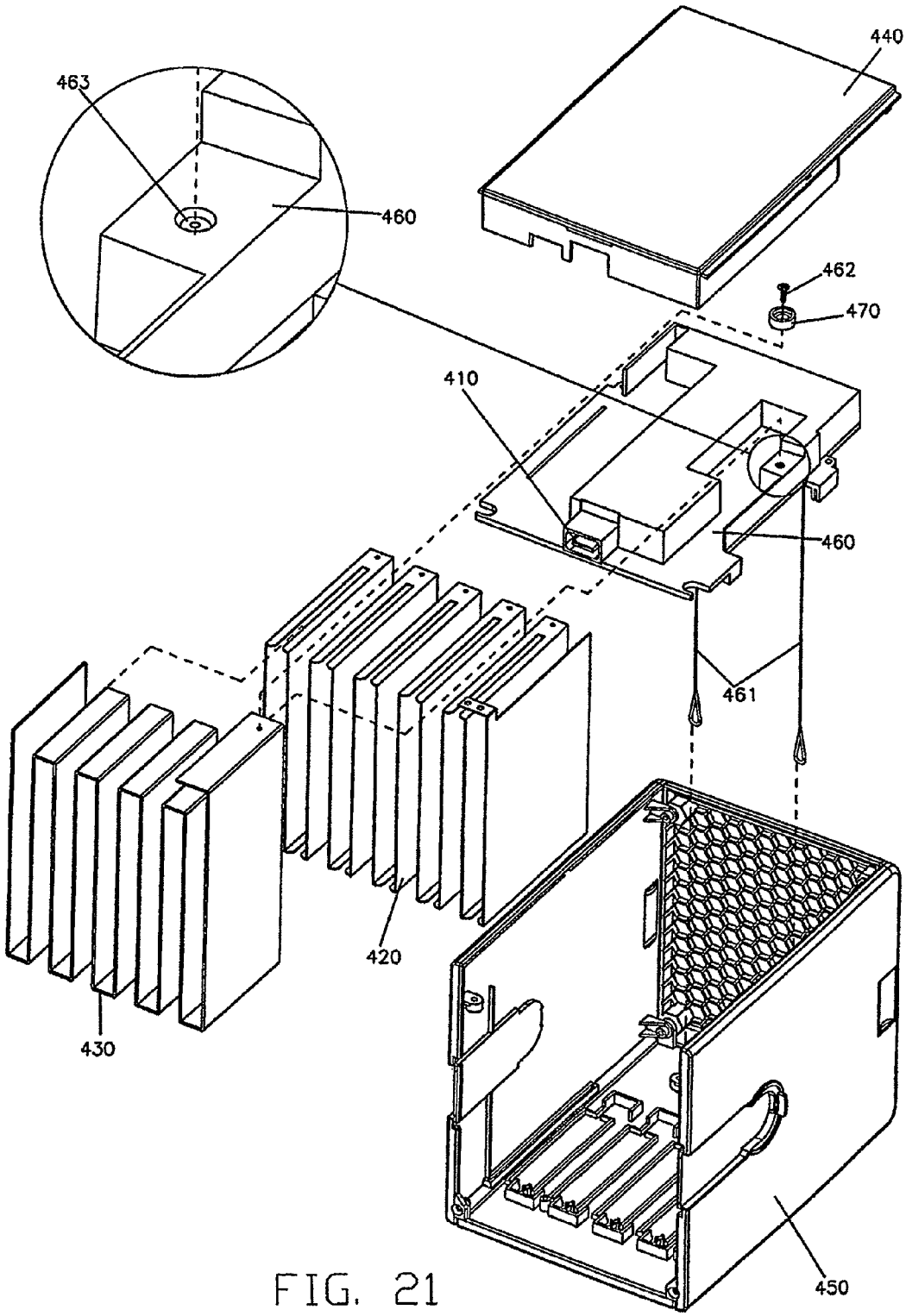
FIG. 21 is an exploded, perspective view of the collector module shown in FIG. 20.

FIGS. 19-21 illustrate an air cleaner of another embodiment of the present invention comprising a removable collector module comprising an integral high voltage module and a low voltage connection between the collector module and a collector module support. This embodiment also comprises a driver electrode module 430 comprising ten insulated driver electrode plates formed from a single, insulated conductive sheet.

With reference to the figures, FIG. 19 illustrates the assembled air cleaner which comprises a collector module 400, a collector module support 500 and, in this illustrated embodiment, a stand 600 on which the collector module support 500 (and consequently the collector module 400) can rotate about a horizontal axis. FIG. 19 illustrates the collector module support and collector module rotated approximately 45 degrees from a vertical position. In this illustrated embodiment, the collector module support and collector module can be rotated to any desired position. Detents or other resilient stops are preferably provided to facilitate the selective angular positioning of the collective modular supports/collective module on the stand, for example, at regular intervals of about 15 degrees.

FIG. 20 shows the collector module support 500 in its lowest, vertical position with the collector module 400 disconnected. FIG. 21 is an exploded view of the main components of the collector module 400. Collector module support 500 comprises a fan 520 and a plug 510 having contacts for providing electrical power and control signals to the collector module. Conventional contacts can be used for the plug and socket connection between plug 510 and a socket 410 on collector module 400.

As best shown in FIG. 21, collector module 400 comprises a main collector casing 450, a cover 440, collector plates 420, insulated driver plates 430 and a high voltage module 460 comprising a high voltage generating circuit (not shown). Socket 410 receives power and control signals from socket 510. As discussed above in connection with the embodiment illustrated in FIGS. 4 and 5, electrical power provided to high voltage module 460 via socket 410 is low voltage electrical power so there is no high voltage connection between the removable collector module 400 and the collector module support 500. Collector plates 420 in this illustrated embodiment are connected to a ground potential output of the high voltage circuit. Insulated driver plates 430 are connected to a high voltage output of the high voltage circuit via output contact 463 on high voltage module 460 utilizing screw 462 disposed in insulating cup 470 which can be filled with epoxy if desired. Emitter wires 461 are connected to outputs (not shown) on the high voltage module 460. Cover 440 and high voltage module 460 are connected to the main collector casing 450 with screws (not shown). According to preferred embodiments of the present invention, the high voltage generating circuit and outputs integrated with a removable collector module are sufficiently electrically shielded to permit ready removal and cleaning of the collector module with cleaning fluid and/or dishwasher detergent in a dishwasher.

Preferred embodiments of the present invention, therefore, provide collector modules with fewer electrical connections, which facilitate cleaning, and eliminate the need for high voltage connections between a removable collector module and the remaining parts of an air cleaner by:

1. Providing electrical connection between an insulated driver electrode and a source of electrical potential or between insulated driver electrodes and at least one other conductor through a hole in or on some edge on the driver electrodes. A biasing force is preferably provided and a conductive element serves as a conductor between the driver electrode(s) and the other conductors.
2. Providing a plurality of insulated driver plates with a single, conductive plate or from a plurality of electrically joined conductive plates which are coated with insulation and then bent.
3. An electrically-shielded, high voltage generating circuit integrated with a readily removable collector module that allows cleaning with cleaning fluid and/or dishwasher detergent.

The invention claimed is:

1. A device for removing particles from a gas by electrostatic precipitation comprising:

at least one emitter;

at least one collector electrode spaced from said emitter, a driver electrode module comprising a plurality of integrally connected, insulated driver electrodes, wherein said plurality of driver electrodes comprises a first driver electrode positioned in spaced relation to a first side of at least one said collector electrode and a second driver electrode positioned in spaced relation to a second side of at least one said collector electrode which is different from said first side.

2. A device for removing particles from a gas according to claim 1 wherein said first driver electrode and said second driver electrode are integrally formed from a single piece of conductive material.

3. A device for removing particles from a gas according to claim 1 wherein said driver electrodes are disposed in spaced, substantially parallel relation to each other.

4. A device for removing particles from a gas according to claim 1 wherein said driver electrode module comprises a plurality of electrically connected conductive portions substantially encased in a substantially continuous insulation.

5. A device for removing particles from a gas according to claim 4 wherein said portions are substantially planar.

6. A device for removing particles from a gas according to claim 1 wherein said driver electrode module comprises at least three, insulated driver electrode plates.

7. A device for removing particles from a gas according to claim 1 wherein said second side is positioned opposite said first side.

8. A device for removing particles from a gas according to claim 1 wherein said first side and said second side are disposed on opposite sides of the same collector electrode.

9. A device for removing particles from a gas according to claim 1 wherein said driver electrode module comprises at least four driver electrode plates positioned proximate three collector electrode plates.

10. A device for removing particles from a gas according to claim 1 wherein said device utilizes a single electrical connector for connecting said driver electrode module to a source of electrical potential.

11. A device for removing particles from a gas according to claim 1 wherein said device comprises a single electrical connector for connecting said driver electrode module to a source of electrical potential.

12. A device for removing particles from a gas according to claim 1 wherein said collector electrode receives an ionization current from said emitter during operation of the device.

13. A device for removing particles from a gas by electrostatic precipitation comprising:

at least one emitter;

at least one collector electrode spaced from said emitter, a plurality of insulated driver electrodes comprising conductive portions substantially surrounded by driver insulation, said driver electrodes electrically connected to each other by an electrical connector and connected to a source of electrical potential, said driver electrodes each comprising at least one connection portion which is not shielded by said driver insulation;

a substantially insulated electrical connector for electrically connecting said insulated driver electrodes, said electrical connector comprising an electrically conductive portion substantially surrounded by connector insulation and at least one access portion on said conductive portion which is not shielded by said connector insulation;

a plurality of conductive connector members positioned in contact with said connection portions of said driver electrodes and said access portion of said conductive portion of said electrical connector;

said insulation of said electrical connector positioned against an insulated surface of each of said insulated driver electrodes;

said insulated driver electrodes and said substantially insulated electrical connectors biased toward each other at least in areas proximate said connection portion and said access portion;

wherein electrical communication is established between said substantially insulated electrical connector and said insulated driver electrodes with the portions of said connector members which contact said connection portion and said access portion.

14. A device for removing particles from a gas by electrostatic precipitation according to claim 13 wherein said conductive portion of said substantially insulated electrical connector comprises holes aligned with said holes in said driver electrodes and said connector members extend through said holes in said insulation and said conductive portion of said electrical connector and through insulation and said holes in said driver electrodes.

15. A device for removing particles from a gas by electrostatic precipitation according to claim 13 wherein at least one of said connector members comprises a threaded rod.

16. A device for removing particles from a gas by electrostatic precipitation according to claim 13 wherein said connector members bias said insulated driver electrodes toward said insulated conductive portion of said electrical connector.

17. A device for removing particles from a gas by electrostatic precipitation according to claim 13 wherein at least one of said connector members comprises a grommet.

18. A device for removing particles from a gas by electrostatic precipitation comprising:

at least one emitter;

at least one collector electrode spaced from said emitter, at least one driver electrode comprising a conductive portion substantially surrounded by a first insulation, said driver electrode electrically connected to a source of electrical potential, said driver electrode comprising at least one connection portion which is not shielded by said first insulation;

a substantially insulated electrical connector for electrically connecting said insulated driver electrode to a source of electrical potential, said electrical connector comprising an electrically conductive portion substantially surrounded by a second insulation and at least one access portion on said conductive portion which is not shielded by said second insulation;

a conductive connector member positioned in contact with said connection portion of said driver electrode and said access portion of said conductive portion of said electrical connector;

said second insulation of said electrical connector positioned against an insulated surface of said insulated driver electrode;

said insulated driver electrode and said substantially insulated electrical connector biased toward each other at least in areas proximate said connection portion and said access portion;

wherein electrical communication is established between said substantially insulated electrical connector and said insulated driver electrode with the portion of said connector member which contacts said connection portion and said access portion.

19. A device for removing particles from a gas by electrostatic precipitation according to claim 18 wherein said connector member biases said insulated driver electrode toward said insulated conductive portion of said electrical connector.

20. A device for removing particles from a gas by electrostatic precipitation according to claim 18 wherein said connector member comprises a threaded rod.

21. A device for removing particles from a gas by electrostatic precipitation according to claim 18 wherein said connector member comprises a grommet.

* * * * *